US009714637B1

(12) United States Patent
Stacey

(10) Patent No.: US 9,714,637 B1
(45) Date of Patent: Jul. 25, 2017

(54) PNEUMATIC STARTER FOR A CHAINSAW

(71) Applicant: Carl A. Stacey, Castleton, VT (US)

(72) Inventor: Carl A. Stacey, Castleton, VT (US)

( * ) Notice: Subject to any disclaimer, the term of this patent is extended or adjusted under 35 U.S.C. 154(b) by 423 days.

(21) Appl. No.: 14/146,363

(22) Filed: Jan. 2, 2014

Related U.S. Application Data

(60) Provisional application No. 61/873,561, filed on Sep. 4, 2013.

(51) Int. Cl.

| | |
|---|---|
| ***F02N 15/10*** | (2006.01) |
| ***F02N 3/02*** | (2006.01) |
| ***F02N 15/06*** | (2006.01) |
| ***F02N 15/00*** | (2006.01) |

(52) U.S. Cl.
CPC ..... *F02N 15/10* (2013.01); *F02N 3/02* (2013.01); *F02N 15/00* (2013.01); *F02N 15/063* (2013.01); *F02N 15/065* (2013.01)

(58) Field of Classification Search
CPC ... F02N 3/00; F02N 3/02; F02N 15/00; F02N 15/063; F02N 15/065; F02N 15/10
USPC ..... 123/185.1, 185.14, 185.2, 185.3, 185.5, 123/185.6, 51 B; 74/6, 7 B, 139, 140; 60/625–631
See application file for complete search history.

(56) References Cited

U.S. PATENT DOCUMENTS 1,614,697 A * 1/1927 Snook ..... B25H 1/0007 212/345
2,238,708 A * 4/1941 Russell ..... F16M 11/30 248/188.7
2,990,858 A 7/1961 Ledger
3,528,563 A * 9/1970 Valory ..... E02D 13/04 414/23
3,856,290 A * 12/1974 Jensen ..... C25D 17/08 204/297.08
4,907,778 A 3/1990 Rockwell
4,919,091 A 4/1990 Wissman et al.
5,078,955 A * 1/1992 Hydeman ..... G21C 17/017 376/248
5,174,166 A * 12/1992 Tryon ..... F02N 3/02 74/140
5,363,116 A * 11/1994 Allen ..... H01Q 1/1235 248/170
6,079,697 A 6/2000 Tuggle et al.
6,119,955 A * 9/2000 Starr ..... B05B 1/083 239/11
6,497,210 B1 * 12/2002 Kattenhorn ..... F02N 3/02 123/185.4
7,107,963 B2 9/2006 Warfel et al.
(Continued)

FOREIGN PATENT DOCUMENTS

EP 1027530 B1 8/2006

*Primary Examiner* — Stephen K Cronin
*Assistant Examiner* — Kevin R Steckbauer
(74) *Attorney, Agent, or Firm* — Robert C. Montgomery; Montgomery Patent & Design, L.P.

(57) ABSTRACT

A pneumatic starter for a chainsaw having a pedestal that supports a mounting plate. Clamps are used to mount a chainsaw to the mounting plate while brackets are used to connect a pneumatic cylinder having an extending shaft to the mounting plate. A recoil handle fixture receives the pull cord of a chainsaw. The recoil handle fixture is connected to the shaft. When a pneumatic assembly receiving compressed air is operated the shaft is rapidly extended, pulling the pull cord to start the chainsaw.

18 Claims, 6 Drawing Sheets

(56) References Cited

U.S. PATENT DOCUMENTS

| | | | | |
|---|---|---|---|---|
| 7,322,334 | B1 * | 1/2008 | O'Brien | B27B 17/00 123/185.4 |
| 7,478,617 | B2 * | 1/2009 | Wang | F02N 3/02 123/185.4 |
| 7,789,379 | B2 * | 9/2010 | Livingston, Jr. | B25B 1/2405 269/249 |
| 8,539,925 | B2 * | 9/2013 | Gleason | F02N 7/02 123/185.2 |
| 2009/0193953 | A1 * | 8/2009 | Romeo | A23N 15/00 83/639.1 |
| 2010/0218459 | A1 * | 9/2010 | Lapin | B65B 25/24 53/397 |
| 2011/0005088 | A1 | 1/2011 | Pellenc | |
| 2011/0265753 | A1 * | 11/2011 | Gleason | F02N 7/02 123/185.2 |
| 2015/0075345 | A1 * | 3/2015 | Romeo | A23N 15/00 83/639.1 |
| 2015/0252769 | A1 * | 9/2015 | Brankin | F02N 3/02 74/6 |

* cited by examiner

PNEUMATIC STARTER FOR A CHAINSAW

RELATED APPLICATIONS

The present invention was first described in and claims the benefit of U.S. Provisional Application No. 61/873,561, filed Sep. 4, 2013, the entire disclosures of which are incorporated herein by reference.

FIELD OF THE INVENTION

The present invention relates to chain saws. More particularly it relates to a pneumatically operated chainsaw starter.

BACKGROUND OF THE INVENTION

The principle tool for cutting trees, trimming branches, cutting firewood and clearing brush is the chainsaw. Fast cutting, cost effective, efficient, useable by one person, the chainsaw is widely used in both rural and urban areas around the world.

Chainsaws are available in electric and gas powered versions. While electric chainsaws have their uses, when it comes to cutting large amounts of firewood or larger trees gas power chainsaws are the preferred tool. The aggressive, fast cutting gas powered chainsaw makes quick work of even the biggest trees no matter how remote the location.

Gas-powered chainsaws easily cut through even hardwood. Unfortunately they also have no problem cutting through meat and bones. Gas-powered chainsaws are known for producing horrific injuries. Many of those injuries occur when starting a gas powered chainsaw. One (1) reason is that a chainsaw is usually started by holding it in only one (1) hand and jerking downward while the other hand pulls on the pull cord to start the saw. This results in the obvious problem that should the chainsaw start and the chain contact the user very serious damage to the user may occur. Not as obvious is the danger of ergonomic injuries caused by the large weight and heavy forces applied to one's arms, shoulder, and back when trying to start a chainsaw. Such problems are magnified when elderly, disabled, or smaller people try to start chainsaws.

Despite its dangers the gasoline-powered chainsaw remains the tool of choice for many jobs. In view of the foregoing there exists a need for devices for safely starting gas-powered chainsaws. Preferably such devices would not only be safe but also quick, easy, effective, and relatively low cost. Beneficially such devices would eliminate having to pull repeatedly on pull cords. Helpfully such devices would reduce or eliminate ergonomic injuries. In practice such devices should be easily adapted to work with different makes and models of gas-powered chainsaws.

SUMMARY OF THE INVENTION

The principles of the present invention provide for a pneumatic tool for safely starting gas-powered chainsaws. The pneumatic tool enables the safe starting of chainsaws in a quick, easy, and effective manner. The pneumatic tool eliminates the need to repeatedly pulling on pull cords while also reducing or eliminating ergonomic injuries. The pneumatic tool is easily adapted to work with different makes and models of gas powered chainsaws.

A chainsaw starter in accord with the present invention includes a pedestal and a mounting plate that is attached to the pedestal. That chainsaw starter also includes at least one (1) swivel clamp for holding a chainsaw to the mounting plate. A pneumatic cylinder having a pneumatically operated shaft is attached to a pneumatic assembly. The pneumatic assembly selectively pressurizes the pneumatic cylinder to extend the shaft. A bracket assembly attaches the pneumatic cylinder to the mounting plate. A recoil handle fixture is attached to the shaft. The recoil handle fixture couples a pull cord of a chainsaw to the shaft.

The swivel clamp preferably takes the form of a first swivel clamp having a first vertical body, a first horizontal member that extends from the first vertical body, a first bolt for passing through the first vertical body and through the mounting plate, and a first knob for receiving the first bolt to fix the first swivel clamp to the mounting plate when the first knob is tightened. The first horizontal member is configured to fit over a first handle of a chainsaw and to secure the chainsaw to the mounting plate when the first swivel clamp is fixed to the mounting plate. In practice there may be a second swivel clamp having a second vertical body, a second horizontal member that extends from the second vertical body, a second bolt for passing through the second vertical body and through the mounting plate, and a second knob for receiving the second bolt to fix the second swivel clamp to the mounting plate when the second knob is tightened. The second horizontal member is configured to fit over a second handle of a chainsaw and to secure the chainsaw to the mounting plate when the second swivel clamp is fixed to the mounting plate.

Beneficially, the bracket assembly includes a cylinder bracket that is attached to the pneumatic cylinder by a jam nut. The bracket assembly may also include a mounting plate bracket that is fixed to the mounting plate and to the cylinder bracket to couple the cylinder bracket to the mounting plate. In practice the bracket assembly positions the pneumatic cylinder at a rearward angle. It is useful to have the mounting plate bracket fixed to the bottom of the mounting plate and it is useful to have the cylinder bracket "L"-shaped. A protective guard should extend from the cylinder bracket.

The pneumatic assembly may include a pneumatic valve that is operatively connected to the pneumatic cylinder. The pneumatic assembly having an actuator button, a flow regulator, an air inlet connector for receiving compressed air and an air outlet connector for discharging air. The shaft extends when the actuator button is activated at a speed that is controlled by the flow regulator.

The pedestal includes a post, a post handle that is fixed to the post, and legs that extend from the post. A leg may have a height-adjustable foot. To attach the mounting plate to the pedestal mounting plate includes a collar that is received by the post. A fastener can be used to fasten the collar and the post together.

The recoil handle fixture preferably includes a generally half-cylinder-shaped saddle for receiving a recoil handle of a chainsaw. That saddle may include a first rest section and a second rest section that are separated by a center slot. The recoil handle fixture may also include an adaptor that extends from the saddle for receiving the shaft. That shaft may be threaded and received in the adaptor. A shaft jam nut can be used to hold the adapter fixed relative to the shaft.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
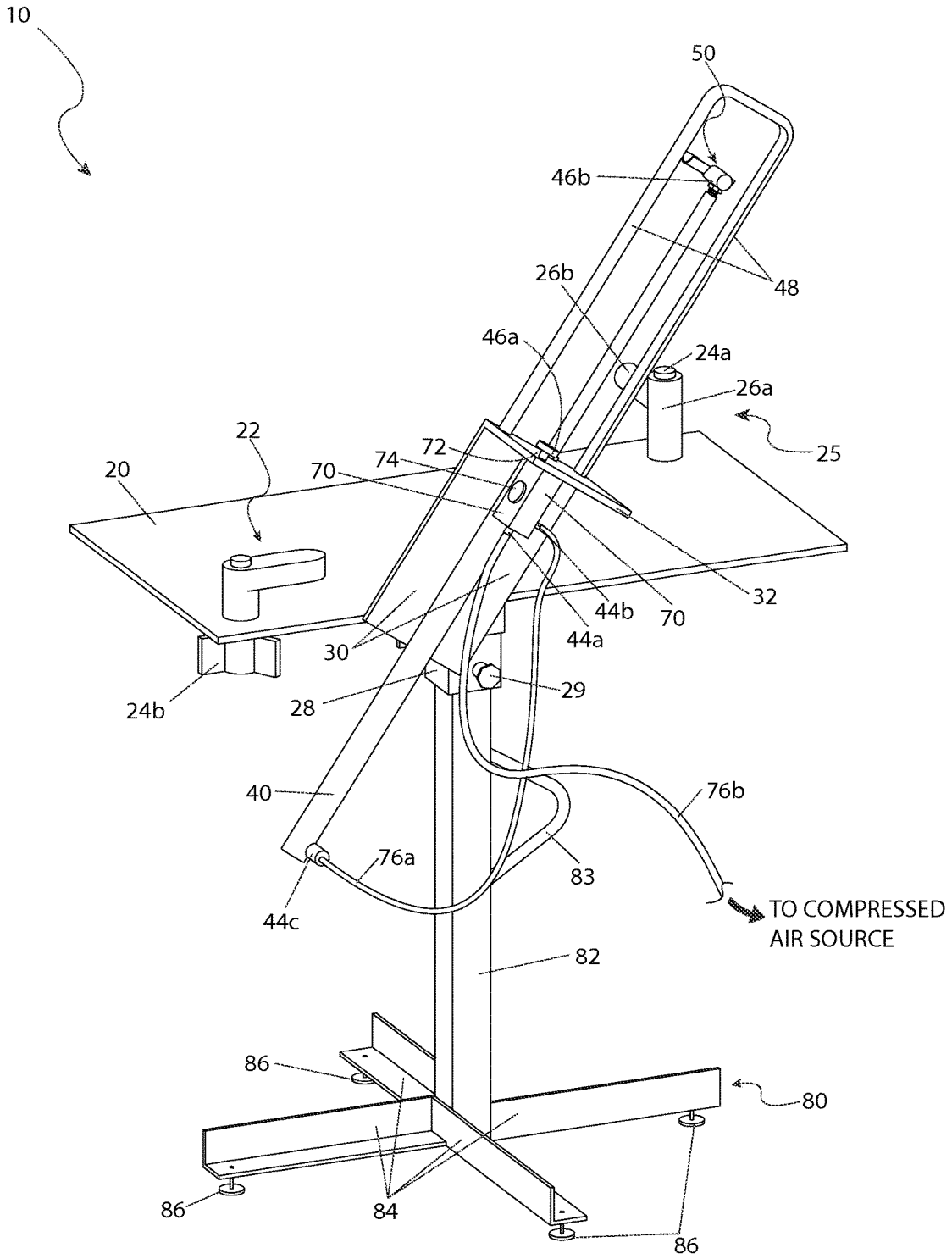
FIG. 1 is a right side perspective view of a pneumatic chainsaw starter 10 that is in accord with a preferred embodiment of the present invention.

10 chainsaw starter
20 mounting plate
21 mounting plate bracket
22 first swivel clamp
22*a* first vertical member
22*b* first horizontal member
24*a* bolt
24*b* knob
25 second swivel clamp
26*a* second vertical member
26*b* second horizontal member
28 collar
29 locking bolt
30 cylinder bracket
32 valve plate
40 pneumatic cylinder
42 shaft
44*a* inlet connector
44*b* outlet connector
44*c* cylinder connector
46*a* first jam nut
46*b* second jam nut
47 threaded end
48 safety guard
50 recoil handle fixture
52 saddle
54 adapter
56*a* first rest surface
56*b* second rest surface
58 center slot
70 valve
72 actuator button
74 flow regulator
76*a* first hose
76*b* second hose
80 pedestal
82 post
83 post handle
84 leg
86 foot
100 chainsaw
102 front handle
104 rear handle
106 bar
108 recoil handle
109 rope attaching portion
120 fastener

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the specifically described embodiment. A person skilled in the art will appreciate that many other embodiments of the invention are possible without deviating from the basic concept of the invention. Any such work around will also fall under scope of this invention. While only one particular configuration is shown and described that is for purposes of clarity and disclosure and not by way of limitation of scope.

The terms "a" and "an" herein do not denote a limitation of quantity, but rather denote the presence of at least one of the referenced items. In addition, direction signals such as up, down, left, right interior, exterior are taken relative to FIG. 1.

Figure 4:
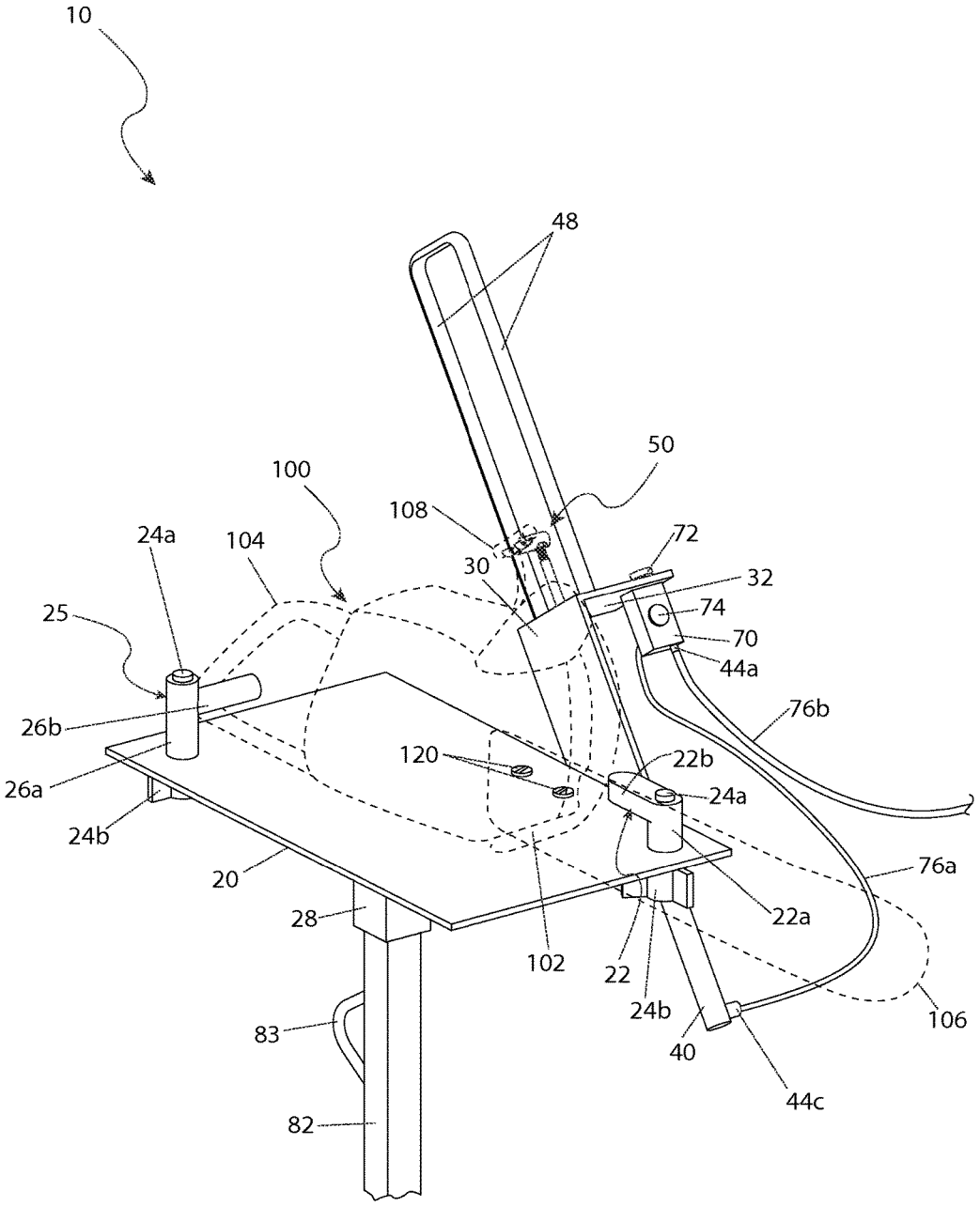
FIG. 4 is another perspective view of the chainsaw starter 10 shown in FIGS. 1 and 2 when in use.

Referring primarily to FIGS. 1 and 4, the present invention describes a chainsaw starter 10 which provides a means to assist in starting a gasoline powered chainsaw 100. The chainsaw starter 10 includes a pedestal 80 having a top mounting plate 20 for securing clamping a chainsaw 100. The recoil handle 108 of the chainsaw 100 is placed within a recoil handle bracket 50 which is rapidly moved outward via an internally spring returned pneumatic cylinder 40 to start the chainsaw 100 (that is, the spring is inside the pneumatic cylinder 40). The chainsaw starter 10 is designed to clamp and start a wide variety of existing chainsaws 100 having conventional features such as, but not limited to a front handle 102, a rear handle 104, a saw bar 106, and a rope-type recoil handle 108.

Figure 5:
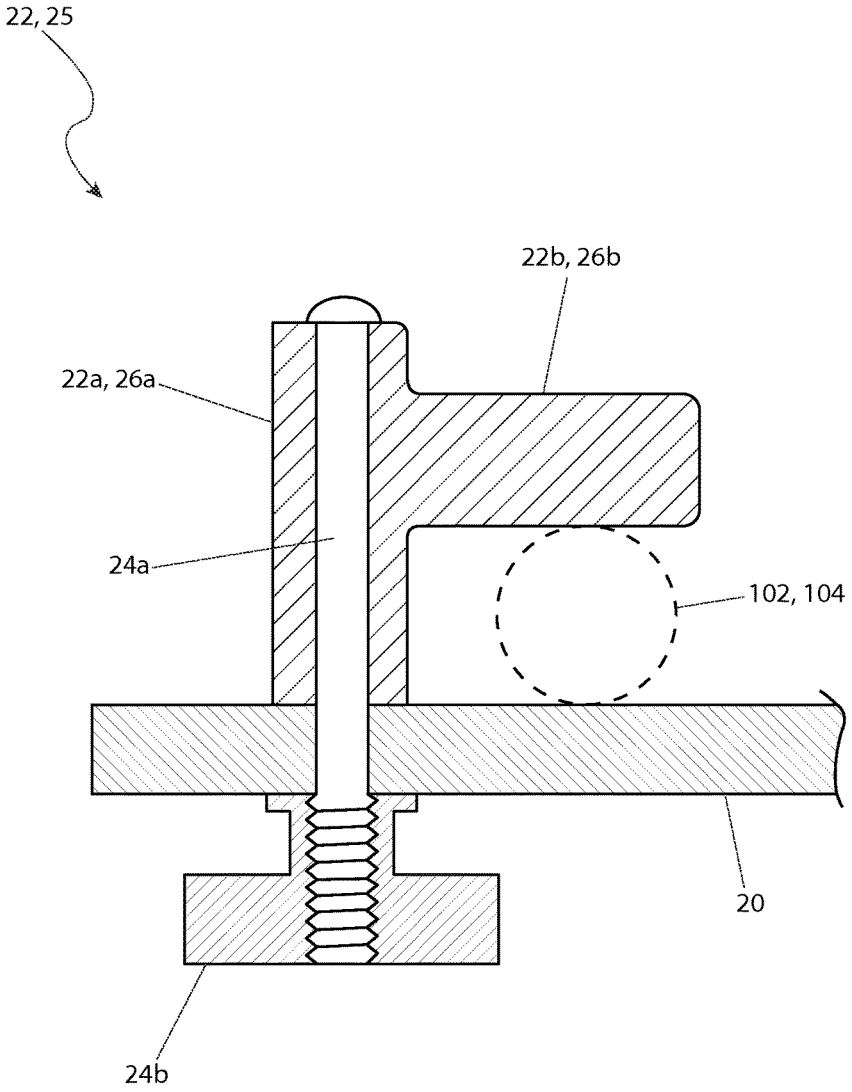
FIG. 5 is a sectional view of a swivel clamp used in the chainsaw starter 10 taken along section line A-A of FIG. 2; and, FIG. 6 is a close-up view of a recoil handle fixture 50 of the chainsaw starter 10.

Referring now primarily to FIGS. 1, 4, and 5 the chainsaw starter 10 provides a horizontal rectangular metal platform that forms a chainsaw mounting plate 20. The chainsaw mounting plate 20 includes a clamping assembly comprised of a first swivel clamp 22 and an identical second swivel clamp 25 for holding the chainsaw 100 in position by clamping down on the chainsaw 100. The first swivel clamp 22 and the second swivel clamp 25 secure the chainsaw 100 by respectively positioning a first horizontal member 22*b* of the first swivel clamp and a second horizontal member 26*b* of the second swivel clamp 25 over the front handle 102 and rear handle 104 of the chainsaw 100. The first horizontal member 22*b* and the second horizontal member 26*b* are tightening down using knobs 24*b*. The first swivel clamp 22 and the second swivel clamp 25 enable both rotational and vertical adjustability. This enables clamping a variety of makes and models of chainsaws 100 to the mounting plate 20. The first swivel clamp 22 and the second swivel clamp 25 are envisioned as being located near opposing corners of the mounting plate 20.

Figure 2:
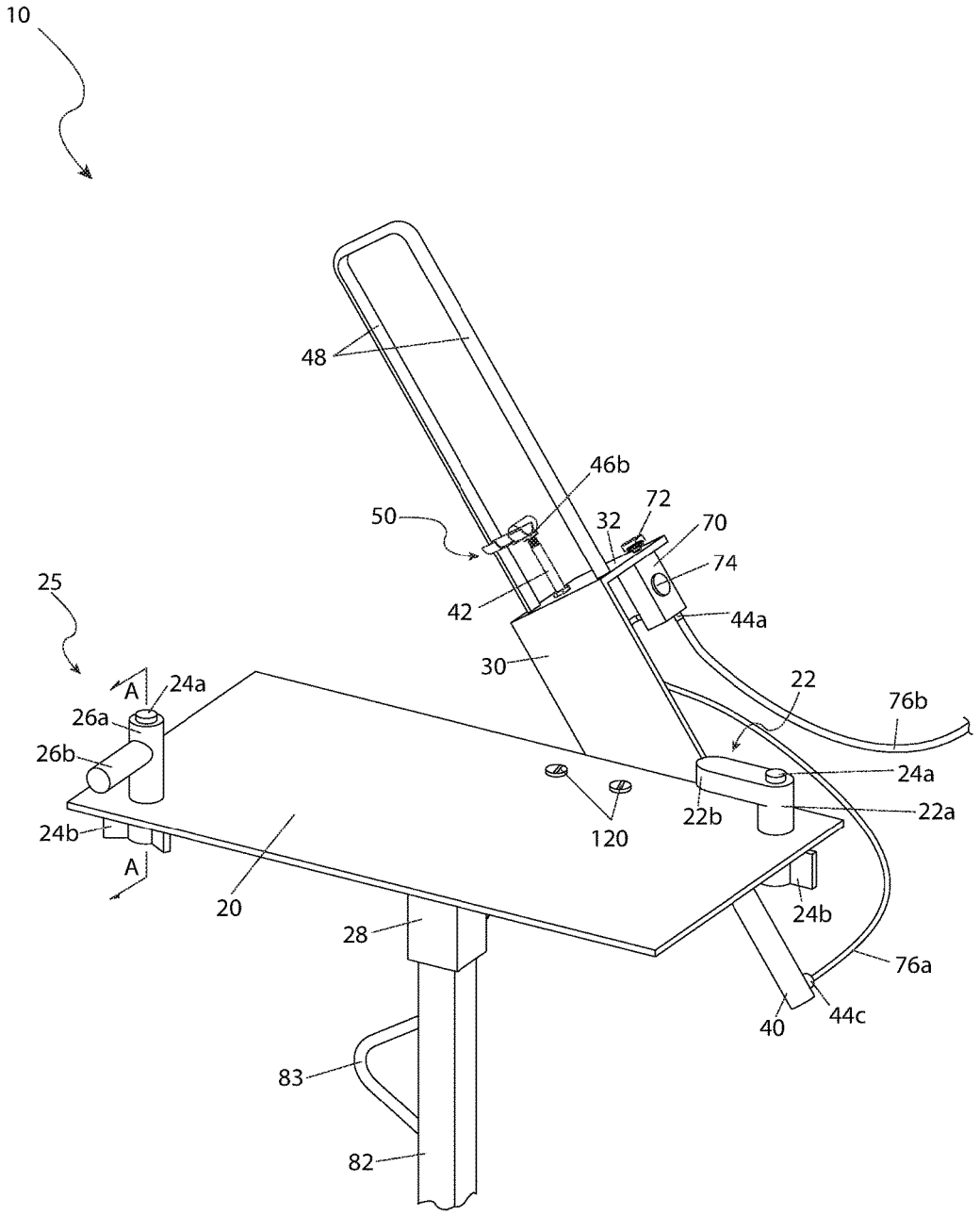
FIG. 2 is a left side perspective view of the chainsaw starter 10 shown in FIG. 1.
Figure 3:
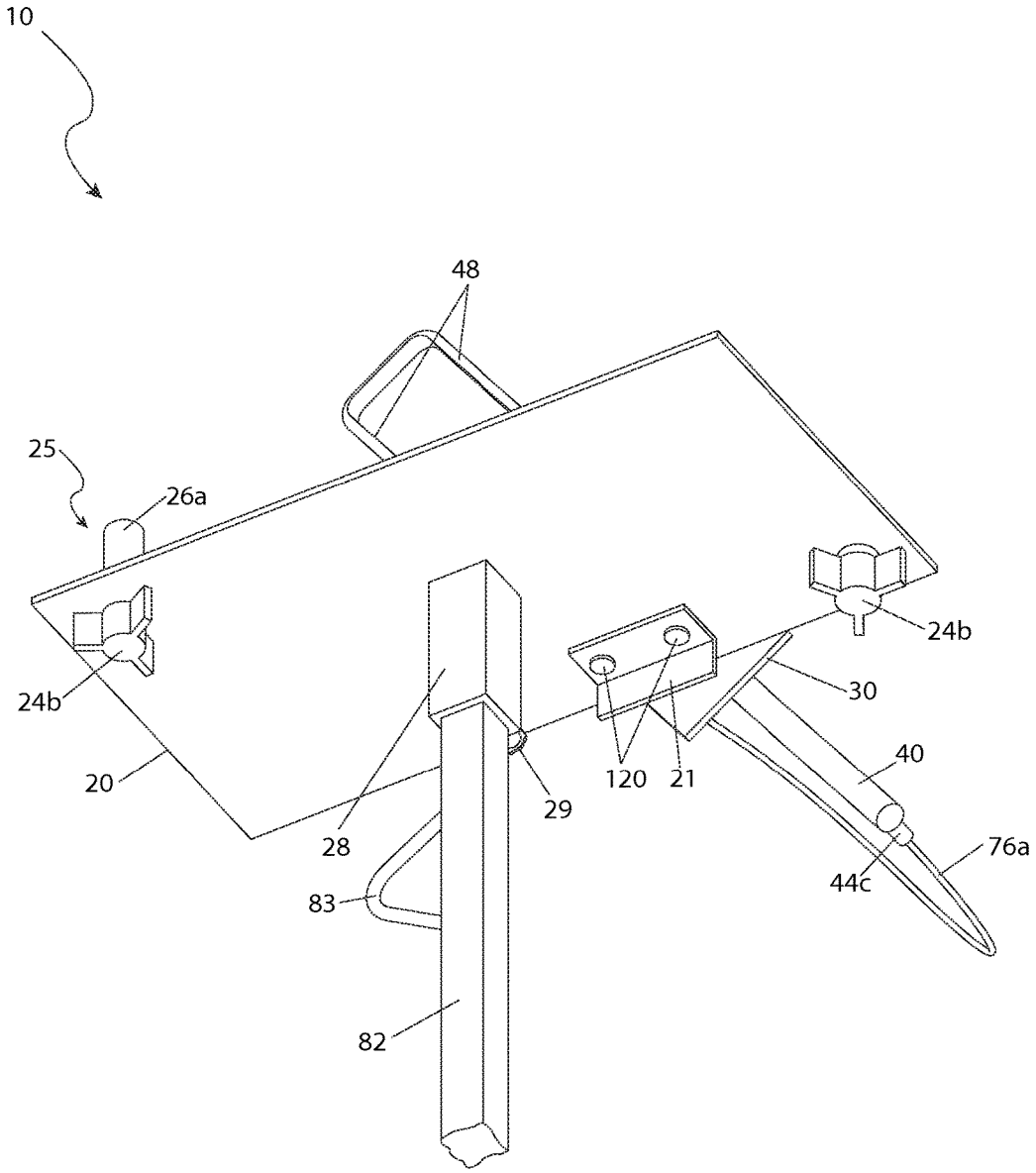
FIG. 3 is a bottom perspective view of the chainsaw starter 10 shown in FIGS. 1 and 2.

Referring to FIGS. 1, 2 and 3, the mounting plate 20 supports the pneumatic cylinder 40 at a rearward angle. This is accomplished using a bracket assembly that includes an affixed "L"-shaped cylinder bracket 30 which attaches to the pneumatic cylinder 40 by a first jam nut 46*a*. The lower edge of the cylinder bracket 30 is fixed to the bottom, outer edge of the mounting plate 20 using a mounting plate bracket 21 of the bracket assembly. The mounting plate bracket 21 is a metal angle that is preferably welded to one side of the cylinder bracket 30 and then fixed to the bottom of the mounting plate 20 by fasteners 120.

The cylinder bracket 30 has a horizontally extending valve plate 32 which supports a safety guard 48. The valve plate 32 also supports a panel-mounted pneumatic valve 70 and a pneumatic assembly. The pneumatic valve 70 includes a spring-return actuator button 72, an integral rotary flow regulator 74 that controls the speed of a cylinder shaft 42 (see FIG. 3), an air inlet connector 44*a*, and an air outlet connector 44*b* (see FIG. 1). The pneumatic valve 70 and the pneumatic cylinder 40 are joined together by a first hose 76*a* to form a pneumatic circuit. Compressed air is supplied to the air inlet connector 44*a* by a second hose 76*b* that is connected to a compressed air source such as an air compressor. The air outlet connector 44*b* in turn is connected to the pneumatic cylinder 40 via the first hose 76*a* and by a cylinder connector 44*c*. The actuator button 72 allows a user to extend a shaft 42 of the pneumatic cylinder 40 by pressing down on the actuator button 72.

The safety guard 48 is an upwardly protruding inverted "U"-shaped structure preferably made of a metal flat stock. The safety guard 48 has parallel sides that are welded, or otherwise affixed to the top of the cylinder bracket 30. The cylinder shaft 42 and recoil handle fixture 50 are positioned between and moved parallel to the sides of the safety guard 48, which protects a user from injury. The safety guard 48 might have a box-shape or another protective design based upon a user's preference, but the inverted "U"-shape is preferred.

The pneumatic air cylinder 40 is a spring-returned unit that is envisioned as providing about fourteen inches (14 in.) of travel. When a chainsaw 100 is to be started the user clamps the chainsaw 100 onto the mounting plate 20, prepares the chainsaw 100 for starting by priming, turning on the ignition or other process, and the presses the actuator button 72. This causes the cylinder shaft 42 to rapidly expand, thereby pulling the recoil handle 108 to start the chainsaw 100. When the actuator button 72 is released the pneumatic cylinder 40 and the recoil handle 108 returned to their home positions.

The mounting plate is located at a convenient height above a floor. To that end the mounting plate 20 is supported by the pedestal assembly 80. The mounting plate 20 is supported on the pedestal assembly 80 via a collar 28 and by a post 82. The collar 28 and post 82 are preferably made of rectangular structural steel tubing dimensioned such that the post 82 slides into the collar 28. The collar 28 is preferably welded at it center to the bottom of the mounting plate 20. The post 82 is retained within the collar 28 via a threaded locking bolt which locks the post 82 inside.

The pedestal assembly 80 also includes a post handle 83, four (4) legs 84, and four (4) height-adjustable feet 86. The post handle 83 enables easy carrying of the chainsaw starter 10. The post handle 83 is preferably made from a section of round steel stock that is formed into a "U" or "V" shape with the ends welded to a side of the post 82 at a convenient height. The legs 84 are sections of steel angle that are perpendicularly welded to the sides of the post 82. Each leg 84 has a threaded, vertically-adjustable round foot 86 on its outer end to provide stable positioning of the chainsaw starter 10 on a floor or other convenient surface.

Figure 6:
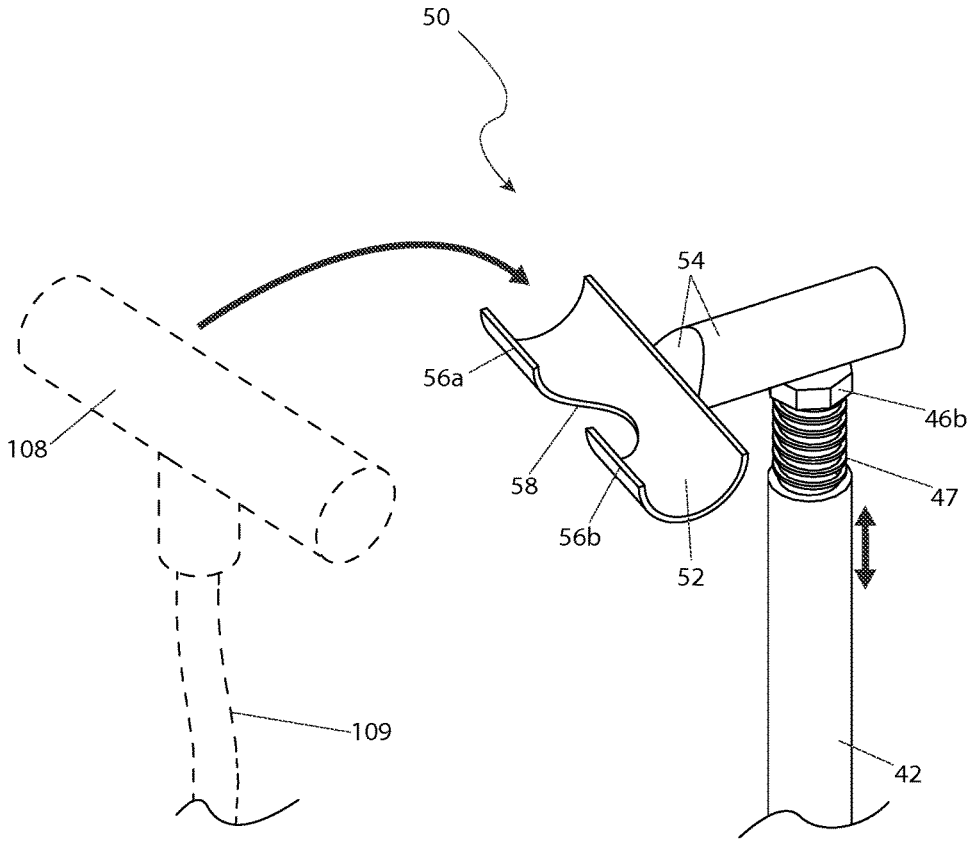

FIG. 6 presents a close-up view of a recoil handle fixture 50 used in the chainsaw starter 10. The recoil handle fixture 50 is preferably a two-piece welded assembly made of a half-cylinder-shaped saddle 52 and an adapter 54. The saddle 52 and an adapter 54 attach the recoil handle fixture 50 to the pneumatic cylinder 40 shaft 42. The saddle 52 has an open top and is configured to position and support a standard "T"-shaped recoil handle 108 of a chainsaw 100. The front of the saddle 52 includes a first rest section 56*a* and a second rest section 56*b* that are separated by a center slot 58. The center slot 58 is about one-half (½) deep and provides clearance for a rope-attachment 109 of the recoil handle 108. The saddle 52 has a radius which emulates that of a recoil handle 108. A cylindrical-shaped adapter 54 is welded to the back of the saddle 52 to extend toward the rear. The adapter 54 is threaded at its bottom to a threaded end 47 of the cylinder shaft 42. The adapter is held in a fixed position relative to the cylinder shaft 42 by a second jam nut 46*b*.

FIG. 4 provides an environmental view of the chainsaw starter 10 when in-use. A chainsaw 100 that is to be started is placed on the mounting plate 20; secured by respectively positioning the first horizontal member 22*b* and the second horizontal member 26*b* of the first swivel clamp 22 and second swivel clamp 25 over respective front 102 and rear 104 handles of the chainsaw. The knobs 24*b* are then tightened. The user then prepares the chainsaw 100 for starting by setting the choke, priming, turning the ON-OFF switch to ON and performing other necessary operations. The user then nests the recoil handle 108 of the chainsaw 100 in the recoil handle fixture 50 and presses the actuator button 72. This causes the shaft 42 to rapidly extend, pulling the recoil handle 108 outward to start the chainsaw 100. This process emulates manual starting of the chainsaw 100 and may be repeated as necessary until the chainsaw 100 is started. Once started, the chainsaw 100 is removed from the chainsaw starter 10 and used in a normal process. The design of the chainsaw starter 10 supports use with different makes and models of chainsaws 100 and reduces the tiresome and potentially dangerous process of starting a chainsaw 100.

FIG. 5 provides a sectional view taken along line A-A of FIG. 2. FIG. 5 illustrates the swivel clamps 22, 25, which are identical, in more detail. The swivel clamps 22, 25 are "L"-shaped structures having a hollow first vertical member 22*a*, 26*a* and a cylindrical first horizontal member 22*b*, 26*b*. A central threaded bolt 24*a* extends through the first vertical member 22*a*, 26*a* and the mounting plate 20. The central threaded bolt 24*a* is secured by the knob 24*b* which draws the first horizontal member 22*b*, 26*b* downward upon a handle 102, 104 of the chainsaw 100. The first swivel clamp 22 and the second swivel clamp 25 are sized and shaped to enable clamping various makes and models of chainsaws 100 (also see FIG. 2). If required the first swivel clamp 22 and the second swivel clamp 25 may be made available in different sizes.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the chainsaw starter 10 it would be installed as indicated in FIG. 4.

The method of installing and utilizing the chainsaw starter 10 is performed by: procuring the chainsaw starter 10; transporting the chainsaw starter 10 using the post handle 83 to a desired location; positioning the chainsaw starter 10 on the floor using the feet 86; adjusting the feet 86 until the mounting plate 20 is level and stable; mounting a chainsaw 100 on the mounting plate 20 by loosening and rotating the swivel clamps 22, 25; placing the chainsaw 100 on the mounting plate 20; rotating the vertical members 22*a*, 26*a* until the horizontal members 22*b*, 26*b* are positioned above the front handle 102 and the rear handle 104 of the chainsaw 100; rotating the knobs 24*b* to clamp the horizontal members

22*b*, 26*b* against the chainsaw handles 102, 104; placing the recoil handle 108 of the chainsaw 100 into the saddle 52; connecting the second hose 76*b* to a source of compressed air; preparing the chainsaw 100 for starting by setting the choke, and performing other necessary operations; pressing the actuator button 72 to extend the pneumatic cylinder 40 and start the chainsaw 100; releasing the actuator button 72 to return the pneumatic cylinder 40 and attached recoil handle 108 to their home positions; repeating using the actuator button 72 until the chainsaw 100 starts; removing the chainsaw 100 from the chainsaw starter 10 for normal cutting process, and benefiting from the reduced effort and reduced dangers associated with starting of a chainsaw 100 afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A chainsaw starter, comprising:

a pedestal;

a mounting plate attached to said pedestal;

at least one swivel clamp for holding a chainsaw to said mounting plate, wherein said swivel clamp comprises:

a vertical member having an upper end and an opposed lower end in contact with said mounting plate;

a horizontal member extending outwardly from said upper end of said vertical member;

a bolt passing entirely through said vertical member and said mounting plate and defining an axis of rotation;

a knob connected to said bolt opposite said vertical member; and wherein rotation of said vertical member about said axis of rotation adjusts an angular orientation of said horizontal member relative to said mounting plate, and wherein rotation of said knob about said axis of rotation adjusts a vertical position of said horizontal member relative to said mounting plate;

a pneumatic cylinder having a pneumatically operated shaft and which is angled from vertical;

a pneumatic assembly attached to said pneumatic cylinder for selectively pressurizing said pneumatic cylinder to extend said shaft;

a bracket assembly attaching said pneumatic cylinder to said mounting plate, said bracket assembly including a valve plate;

a recoil handle fixture attached to said shaft for coupling a pull cord of a chainsaw to said shaft; and a protective safety guard that extends from said valve plate;

wherein said recoil handle fixture moves within said safety guard.

2. The chainsaw starter of claim 1, wherein said at least one swivel clamp is a first swivel clamp having a first vertical body, a first horizontal member extending from said first vertical body, a first bolt passing through said first vertical body and through said mounting plate, and a first knob receiving said first bolt to attach said first swivel clamp to said mounting plate, wherein said first horizontal member is configured to fit over a first handle of a chainsaw and to secure the chainsaw to said mounting plate when said first knob is tightened.

3. The chainsaw starter of claim 2, further including a second swivel clamp having a second vertical body, a second horizontal member extending from said second vertical body, a second bolt for passing through said second vertical body and through said mounting plate, and a second knob for receiving said second bolt to attach said second swivel clamp to said mounting plate, wherein said second horizontal member is configured to fit over a second handle of a chainsaw and to secure the chainsaw to said mounting plate when said when said second knob is tightened.

4. The chainsaw starter of claim 1, wherein said bracket assembly includes a cylinder bracket attached to said pneumatic cylinder by a jam nut.

5. The chainsaw starter of claim 4, wherein said bracket assembly further includes a mounting plate bracket fixed to said mounting plate and to said cylinder bracket, said mounting plate bracket coupling said cylinder bracket to said mounting plate.

6. The chainsaw starter of claim 5, wherein said mounting plate bracket is fixed to the bottom of said mounting plate.

7. The chainsaw starter of claim 4, wherein said cylinder bracket is "L"-shaped.

8. The chainsaw starter of claim 1, wherein said pneumatic assembly includes a pneumatic valve operatively connected to said pneumatic cylinder, said pneumatic assembly having an actuator button, a flow regulator, an air inlet connector for receiving compressed air and an air outlet connector for discharging air.

9. The chainsaw starter of claim 8, wherein said shaft extends when said actuator button is activated.

10. The chainsaw starter of claim 9, wherein the speed of said shaft is controlled by said flow regulator.

11. The chainsaw starter of claim 1, wherein said pedestal includes a post, a post handle fixed to said post, legs extending from said post, and a height-adjustable foot located on a bottom of a leg.

12. The chainsaw starter of claim 11, wherein said mounting plate includes a collar that is received by said post.

13. The chainsaw starter of claim 12, further including a fastener fastening said collar and said post together.

14. The chainsaw starter of claim 1, wherein said recoil handle fixture includes a generally half-cylinder-shaped saddle for receiving a recoil handle of a chainsaw.

15. The chainsaw starter of claim 14, wherein said saddle includes a first rest section and a second rest section that are separated by a center slot.

16. The chainsaw starter of claim 15, wherein said recoil handle fixture further includes an adaptor extending from said saddle for receiving said shaft.

17. The chainsaw starter of claim 16, wherein said shaft is threaded and received in said adaptor.

18. The chainsaw starter of claim 16, wherein said adapter is held in a fixed position relative to said shaft by a shaft jam nut.

* * * * *